US007884682B2

(12) United States Patent
Nagaishi et al.

(10) Patent No.: US 7,884,682 B2
(45) Date of Patent: Feb. 8, 2011

(54) WAVEGUIDE TO MICROSTRIP TRANSDUCER HAVING A RIDGE WAVEGUIDE AND AN IMPEDANCE MATCHING BOX

(75) Inventors: Hideyuki Nagaishi, Hachioji (JP); Hiroshi Shinoda, Kodaira (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/945,329

(22) Filed: Nov. 27, 2007

(65) Prior Publication Data

US 2008/0129409 A1 Jun. 5, 2008

(30) Foreign Application Priority Data

Nov. 30, 2006 (JP) ..... 2006-323806

(51) Int. Cl.
*H01P 5/107* (2006.01)
*H01P 5/02* (2006.01)

(52) U.S. Cl. ..... 333/26; 333/34; 333/35

(58) Field of Classification Search ..... 333/26, 333/34, 35
See application file for complete search history.

(56) References Cited

U.S. PATENT DOCUMENTS 2,877,429 A 3/1959 Sommers et al.
3,697,902 A 10/1972 Louvel
3,969,691 A 7/1976 Saul
4,453,142 A 6/1984 Murphy
4,675,623 A 6/1987 Nowak et al.
4,973,925 A * 11/1990 Nusair et al. ..... 333/26
5,361,049 A 11/1994 Rubin et al.
5,414,394 A 5/1995 Gamand et al.
5,726,664 A 3/1998 Park et al.
5,793,263 A 8/1998 Pozar
5,867,073 A 2/1999 Weinreb et al.
5,912,598 A 6/1999 Stones et al.
5,982,250 A * 11/1999 Hung et al. ..... 333/26

(Continued)

FOREIGN PATENT DOCUMENTS

DE 44 41 073 C1 1/1996

(Continued)

OTHER PUBLICATIONS

Japanese Office Action received in Japanese App. No. 2006-323806, and English language translation thereof.

(Continued)

*Primary Examiner*—Benny Lee
(74) *Attorney, Agent, or Firm*—Miles & Stockbridge P.C.

(57) ABSTRACT

When a microstrip line is connected with a waveguide, there is a limit to reducing the connection loss by using only a matching box. We have discovered that in a transmission mode line transducer for converting between the TEM waves of the microstrip line and the TE01 waves of the waveguide, if the cross-sections of the microstrip line and the waveguide are substantially the same size, in the case of a 50Ω microstrip line when the characteristic impedance of the waveguide is about 80%, i.e., 40Ω, the line conversion loss can be optimized. Therefore, according to the present invention, the microstrip line is connected with the waveguide using a λ/4 matching box by means of a ridged waveguide having a low impedance and a length of λ/16 or less.

20 Claims, 16 Drawing Sheets

U.S. PATENT DOCUMENTS

| | | | |
|---|---|---|---|
| 6,060,959 | A | 5/2000 | Yakuwa |
| 6,127,901 | A | 10/2000 | Lynch |
| 6,239,669 | B1 | 5/2001 | Koriyama et al. |
| 6,396,363 | B1 | 5/2002 | Alexanian et al. |
| 6,639,484 | B2 | 10/2003 | Tzuang et al. |
| 6,794,950 | B2 | 9/2004 | du Toit et al. |
| 6,822,528 | B2 | 11/2004 | Dawn et al. |
| 6,958,662 | B1 | 10/2005 | Salmela et al. |
| 7,068,121 | B2 | 6/2006 | Ding et al. |
| 7,095,292 | B2 | 8/2006 | Sayanagi et al. |
| 7,102,458 | B2 | 9/2006 | Koriyama et al. |
| 7,148,765 | B2 | 12/2006 | Tahara et al. |
| 7,276,987 | B2 | 10/2007 | Koriyama |
| 7,680,464 | B2 | 3/2010 | Pleva et al. |
| 2002/0097108 | A1 | 7/2002 | Jain |
| 2002/0097109 | A1 | 7/2002 | du Toit et al. |
| 2005/0017818 | A1 | 1/2005 | Kinayman et al. |
| 2007/0085626 | A1 | 4/2007 | Lee et al. |
| 2008/0129408 | A1 | 6/2008 | Nagaishi et al. |

FOREIGN PATENT DOCUMENTS

| | | | |
|---|---|---|---|
| EP | 1 592 081 | A1 | 11/2005 |
| JP | 7-202524 | A | 8/1995 |
| JP | 2000-216605 | A | 8/2000 |
| JP | 2002-208807 | A | 7/2002 |
| WO | WO 02/33782 | A1 | 4/2002 |

OTHER PUBLICATIONS

A Compact Manufacturable 76-77-GHz Radar Module for Commercial ACC Applications, IEEE Transactions on Microwave Theory and Techniques, Jan. 2001, pp. 44-58, vol. 49, No. 1, IEEE Services Center, Piscataway, NJ USA.

* cited by examiner

WAVEGUIDE TO MICROSTRIP TRANSDUCER HAVING A RIDGE WAVEGUIDE AND AN IMPEDANCE MATCHING BOX

CLAIM OF PRIORITY

The present invention claims priority from Japanese application JP 2006-323806 filed on Nov. 30, 2006, the content of which is hereby incorporated by reference into this application.

FIELD OF THE INVENTION

The present invention relates to a waveguide structure that functions as a line transducer between a microstrip line and a waveguide.

BACKGROUND OF THE INVENTION

Japanese Patent Application Laid-Open Publication No. 2002-208807 and Japanese Patent Application Laid-Open Publication No. 2000-216605 disclose an example of a line transducer (a line transition element) that performs conversion between a microstrip line and a waveguide. FIG. 14 shows a first embodiment, and FIG. 15 shows a second embodiment, of Japanese Patent Application Laid-Open Publication No. 2002-208807. In this conventional technology, a microstrip line 210 and an external waveguide 212 are connected via a dielectric ridged waveguide 211. The line transducer in FIG. 14 includes a multilayer dielectric substrate 201*b* laminated on an external waveguide 212, a dielectric substrate 201*a* laminated above this, a ground conductor pattern 202 laminated on the undersurface of the dielectric substrate 201*a*, a strip conductor pattern 203 laminated on the top surface of the dielectric substrate 201*a*, waveguide-forming conductor patterns 204*a*, 204*b* provided on each surface of the multilayer conductor substrate 201*b*, ridge-forming conductor patterns 205*a*, 205*b*, a ground conductor pattern gap 206 provided on the ground conductor pattern 202, a conductor pattern gap 207 provided on the waveguide-forming conductor pattern 204*b*, a waveguide-forming via 208, and ridge-forming via 209. The strip conductor pattern 203 and ground conductor pattern 202 disposed on the top and bottom of the dielectric substrate 201*a* form the microstrip line 210. The dielectric substrate 201*a*, multilayer dielectric substrate 201*b*, ground conductor pattern 202, waveguide-forming conductor patterns 204*a*, 204*b*, ridge-forming conductor patterns 205*a*, 205*b*, and waveguide-forming via 208 and ridge-forming via 209, form the dielectric ridged waveguide 211.

The line transducer of FIG. 15 includes a multilayer dielectric substrate 201*b* laminated on an external waveguide 212, a dielectric substrate 201*a* laminated above this, a ground conductor pattern 202 laminated on the undersurface of the dielectric substrate 201*a*, a strip conductor pattern 203 laminated on the top surface of the dielectric substrate 201*a*, waveguide-forming conductor patterns 204*a*, 204*b* provided on each surface of the multilayer conductor substrate 201*b*, ridge-forming conductor patterns 205*a*, 205*b*, a ground conductor pattern gap 206 provided on the ground conductor pattern 202, a conductor pattern gap 207 provided on the waveguide-forming conductor pattern 204*b*, a waveguide-forming via 208.

The line transducer of FIG. 15 further includes ridge-forming vias 209*a*, 209*b*, these ridge-forming vias 209*a*, 209*b* forming the dielectric ridged waveguide 211, and functioning as a two-step impedance transformer.

In the example disclosed in Japanese Patent Application Laid-Open Publication No. 2000-216605, a line transducer between a microstrip line (radiofrequency line conductor) and the waveguide is a "ridged waveguide" formed in a step-like shape wherein a connecting line conductor is disposed parallel in the same transmission direction as that of the microstrip line, and the gap between upper and lower main conductor layers in the waveguide line of the connecting part is made narrow.

The standard waveguide which is designed from the viewpoint of suppressing conductor loss has a characteristic impedance of several hundred Ω. In order to directly connect to the standard waveguide, it will be assumed that the characteristic impedance of an external waveguide (e.g., the external waveguide 212 in FIG. 24) is equal to the characteristic impedance of the standard waveguide such that the reflection loss is low. On the other hand, the characteristic impedance of a microstrip line is often designed to be 50Ω so as to match the IC in the measurement system or the RF (Radio Frequency) circuit. To connect a transmission line of such different characteristic impedance, a λ/4 transducer is used.

When a transmission line having a characteristic impedance of $Z_1$ is connected to a transmission line having a characteristic impedance of $Z_2$, the λ/4 transducer is a line of length λ/4 having a characteristic impedance of $Z_3$ ($:Z_3=\sqrt{(Z_1*Z_2)}$). The magnitude relationship between the characteristic impedances is given by inequality (1):

$$Z_2<Z_3<Z_1 \quad (1)$$

In the example of Japanese Patent Application Laid-Open Publication No. 2002-208807, it is seen that if the characteristic impedance of the external waveguide 212 is $Z_1$, and the characteristic impedance of the microstrip line 210 is $Z_2$, the characteristic impedance of the dielectric ridged waveguide 211 is $Z_3$, which is an intermediate value between $Z_1$ and $Z_2$. As a means of decreasing the characteristic impedance of the dielectric ridged waveguide 211 to less than that of the external waveguide, the shortest side of the rectangular cross-section of the waveguide can simply be shortened, but since a ridged waveguide having a transmission mode approximating that of the microstrip line is ideal, this is what is used in the conventional technology.

However, if the characteristic impedance ratio between the external waveguide 212 and microstrip line 210 is large, the reflection loss increases, and it is difficult to suppress the line transition loss to a minimum. In the example of Japanese Patent Application Laid-Open Publication No. 2002-208807, in order to resolve this problem, the lengths of the ridge-forming vias 209*a*, 209*b* forming the dielectric ridged waveguide 211 are respectively arranged to be λ/4, and the dielectric ridged waveguide 211 is split as shown in FIG. 15. Thus, plural dielectric ridged waveguides having different characteristics impedances were disposed in columns between the external waveguide 212 and microstrip line 210, and by suppressing the characteristic impedance ratio, the line transition loss was suppressed.

One subject should be taken into consideration in using waveguides of this structure is that of reducing the line loss due to the conversion of characteristic impedances and transmission modes between the microstrip lines and the waveguides.

In the conventional technology, characteristic impedance matching between these lines is achieved using a λ/4 matching box, which is a millimeter waveband impedance matching means, to reduce the assembly loss. In another technique, to connect a transmission line having a large characteristic impedance difference, a line transducer is formed using plural λ/4 transducers to reduce the reflection loss, as shown in FIG. 15.

FIG. 9 shows the reflection loss of a line transducer using an ordinary λ/4 transducer. Here, a low impedance waveguide and a 380Ω standard waveguide are connected using a λ/4 transducer. The diagram shows the results of a simulation using four characteristic impedances, i.e., 40Ω, 108Ω, 158Ω, and 203Ω. It is seen that for a connection with a 203Ω waveguide having a characteristic impedance ratio of about 2, the reflection loss is −34 dB, and with 40Ω having a characteristic impedance ratio of about 9, the reflection loss worsens to −11 dB.

For example, for a 50Ω microstrip line with a 380Ω standard waveguide, since the characteristic impedance ratio is about 8, the characteristic impedance ratio must be reduced by using two or more λ/4 transducers having a characteristic impedance ratio of about 3≈380/108 to keep the reflection loss at −20 dB or below. If $Z_1=3*Z_2$, the characteristic impedance $Z_3$ of the λ/4 transducer is given by equation (2):

$$Z3\sqrt{Z1\times Z2}=\sqrt{3}\cdot Z2 \quad (2)$$

Therefore, the characteristic impedance of the λ/4 transducer which is first connected to the microstrip line, is that of an 86Ω waveguide having a characteristic impedance of √3 times 50Ω, i.e., 86Ω.

However, for connecting between a microstrip line and a waveguide, the waveguide structure is not sufficient in itself to achieve loss reduction only by characteristic impedance matching of the line.

SUMMARY OF THE INVENTION

It is therefore a main subject of the present invention to reduce the line conversion loss arising during transmission mode conversion between TEM waves of the microstrip line and waveguide TM01 mode waves in a waveguide structure used as a line transducer between a microstrip line and a waveguide.

One representative example of the present invention is described below. Specifically, a waveguide structure of the invention comprising a microstrip line; a standard waveguide; and a transmission mode transducer provided therebetween, wherein the transmission mode transducer comprising a waveguide transducer, and wherein the characteristic impedance of the waveguide transducer is equal to or less than the characteristic impedance of the microstrip line. The waveguide structure can comprise a multilayer substrate. An RF circuit board and an RF circuit also can be provided. The RF circuit can be provided on a top layer of the RF circuit board and the multilayer substrate. The microstrip line can constitute a millimeter waveband data line of the RF circuit.

According to the present invention, in line conversion between the microstrip line and the waveguide, the loss arising during transmission mode conversion between TEM waves of the microstrip line and TM01 mode waves of the waveguide structure is reduced by interposing a transmission mode transducer having a ridged waveguide section of lower characteristic impedance than that of the microstrip line.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENTS

Figure 1A:
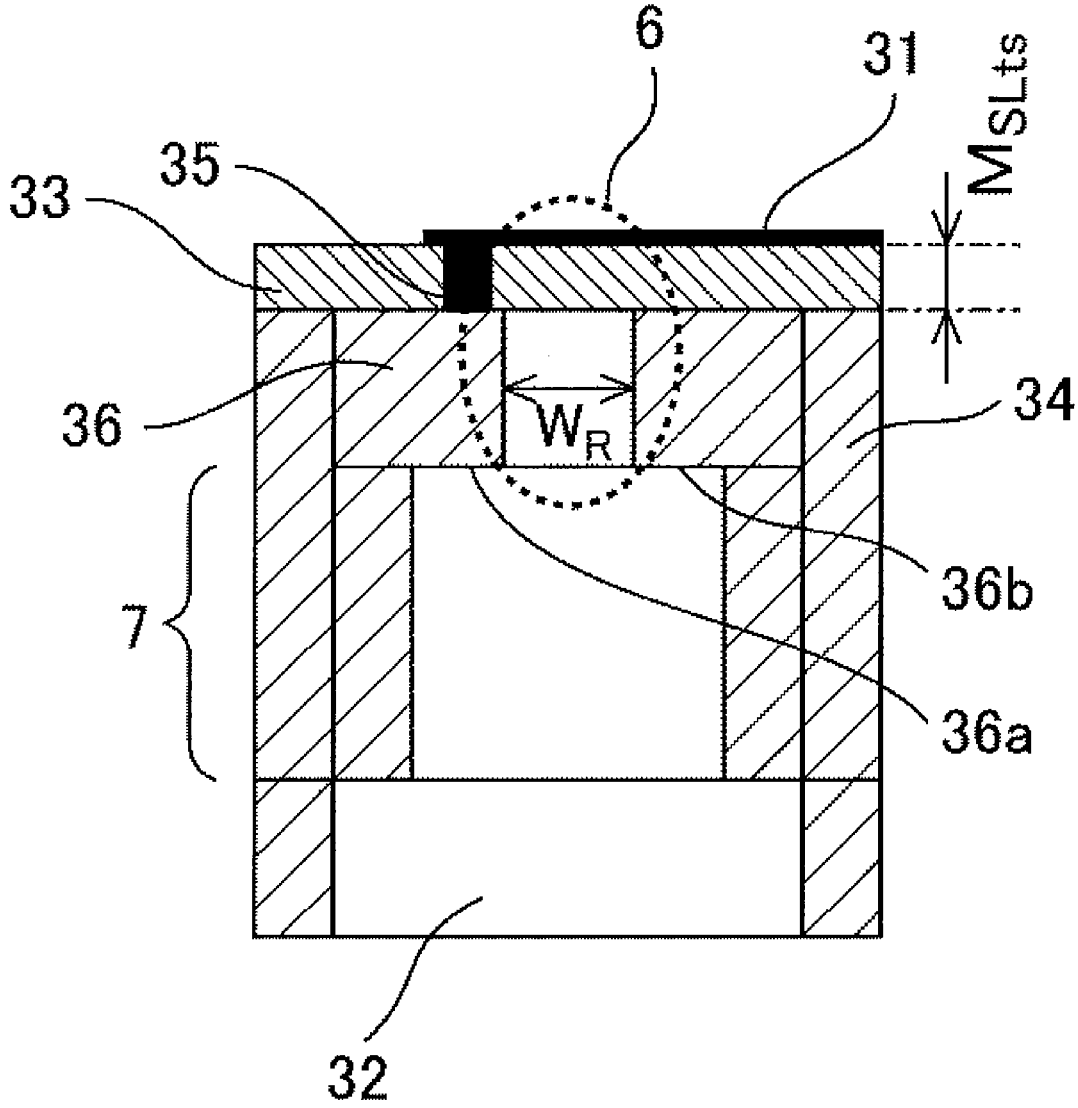
FIG. 1A is a vertical cross-section showing one example of a transmission mode transducer between a microstrip line and a waveguide in a waveguide structure according to a first embodiment of the present invention.

We the inventors have discovered that in transmission mode line conversion between the TEM waves of the microstrip line and the TE01 mode waves of the waveguide, if the cross-sections are substantially the same size, the electromagnetic wave distribution of the TEM waves of the microstrip line and the electromagnetic wave distribution of the TE01 mode waves around the ridges of the ridged waveguide become equivalent, and the line conversion loss then becomes smaller. The microstrip line is open on its main line side upper surface. Since the circumference of the ridged waveguide is shielded with metal, the capacitance component in the rectangular part of the waveguide cross-section, except around the ridges, causes the impedance to drop when the cut-off frequency of the waveguide is reduced. In the case of a 50Ω microstrip line, when the characteristic impedance of the waveguide is about 80%, i.e., 40Ω, the line conversion loss can be optimized. Therefore, the microstrip line is connected with the waveguide using a λ/4 matching box via a ridged waveguide having a low impedance and a length of λ/16 or less, and the line conversion loss of the transmission mode is thereby reduced. The waveguide structure can comprise a multilayer substrate. An RF circuit board and an RF circuit also can be provided. The RF circuit can be provided on a top layer of the RF circuit board and the multilayer substrate. The microstrip line can constitute a millimeter waveband data line of the RF circuit.

Hereafter, suitable embodiments of the invention will be described in detail referring to the drawings.

First Embodiment

Figure 1B:
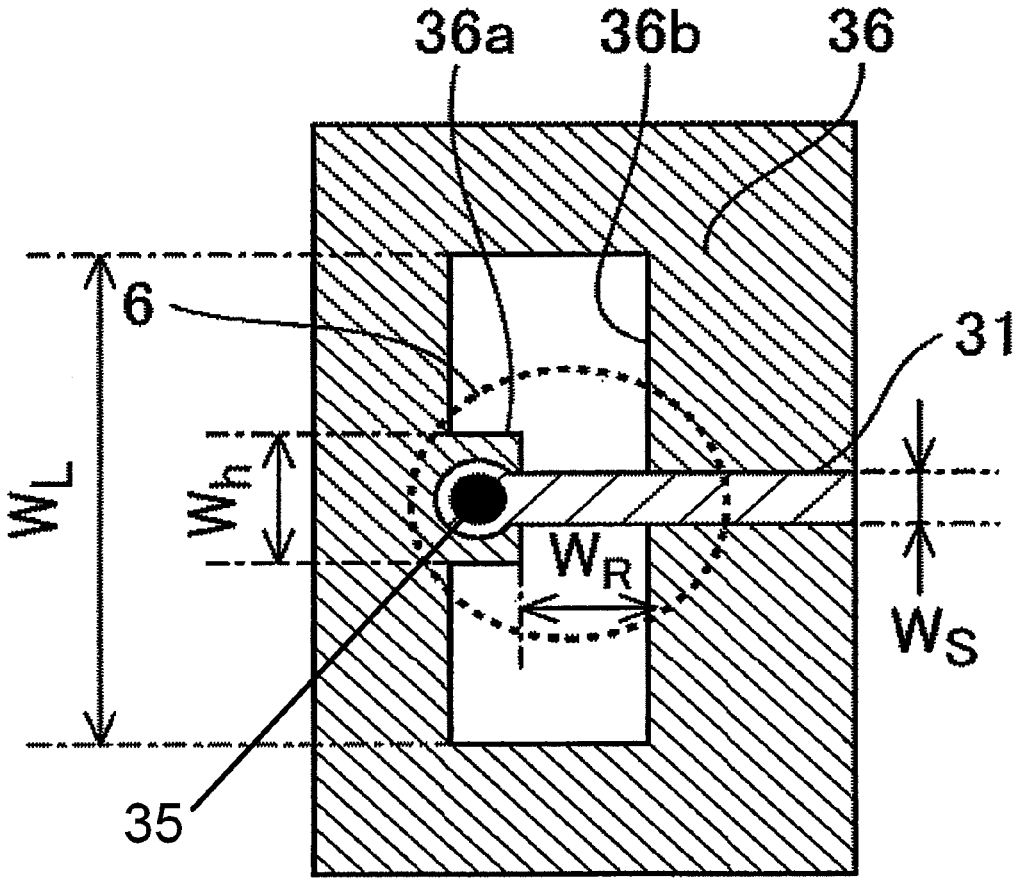
FIG. 1B is an upper plan view of FIG. 1A.
Figure 2:
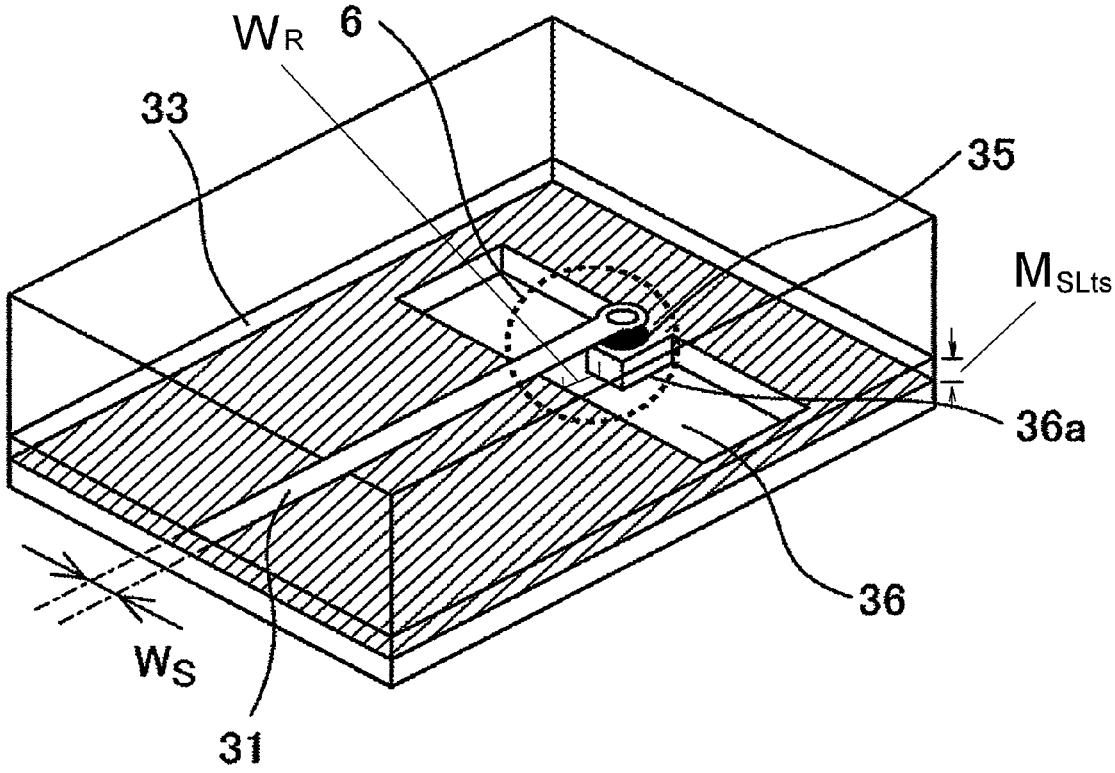
FIG. 2 is a perspective view of the transmission mode transducer of FIG. 1A.

FIGS. 1A, 1B, and 2 show a first embodiment of the waveguide structure according to the present invention.

The construction and function of the transmission mode transducer 6 which is a characteristic feature of the present invention, will first be described. FIG. 1A is a vertical cross-section showing an example of a line transducer of a microstrip line and waveguide in the waveguide structure. FIG. 1B is a plan view of FIG. 1A. FIG. 2 is a perspective view of the line transducer in FIG. 1A. Reference numeral 31 is the main line of a microstrip line, reference numeral 32 (FIG. 1A) is a standard waveguide, and reference numeral 33 (FIGS. 1A, 2) are dielectric substrates for forming the microstrip line. The transmission mode transducer 6 is a line transducer having a waveguide transducer connected between the main line 31 of the microstrip line and a matching box 7 (FIG. 1A). The transmission mode transducer 6 connected between microstrip line and standard waveguide has a waveguide transducer, i.e., a ridged waveguide section, and in this embodiment, a characteristic impedance ($Z_2$) of the waveguide transducer is equal to or less than the characteristic impedance ($Z_1$) of the microstrip line.

The transmission mode transducer 6 includes an electrically conductive conductor 34 (FIG. 1A), a via 35 that electrically connects the main line 31 with the electrically conductive conductor 34, and a ridged waveguide section 36 of reduced impedance. Reference numeral 36*a* is a ridge of the ridged waveguide section connected to the via 35, and reference numeral 36*b* (FIGS. 1A, 1B) is a ridge of a ridged waveguide section that also functions as a GND conductor of the microstrip line 31. The microstrip line 31 and ridged waveguide section 36 are connected at right angles by the transmission mode transducer 6. The ridged waveguide section 36 and λ/4 matching box 7 are formed of the same material as that of the electrically conductive conductor, and are designed to have the same potential under a direct current.

The construction and the effect of making the characteristic impedance ($Z_2$) of the waveguide transducer equal to or less than the characteristic impedance ($Z_1$) of the microstrip line, will now be described. A ridged gap is $W_R$ (FIGS. 1A and 1B), a dielectric thickness is $M_{SLts}$, and a width of the microstrip line is $W_S$ (see FIGS. 1B and 2). In the ridged waveguide 36, the length of the shorter side of the rectangular cross-sectional opening is twice or more than twice the thickness $M_{SLts}$ of the dielectric 33 of the microstrip line. Near the center of one or both of the long sides of the ridged waveguide cross-section, a projection (ridge) having a distance from the nearest contact part of twice or less than twice the dielectric thickness $M_{SLts}$, projects towards the center of the rectangle, and is connected such that the characteristic impedance of the waveguide is equal to or less than that of the microstrip line.

The length of the ridged waveguide section 36 is λ/16 or less.

The characteristic impedances are defined as follows. The impedance of the microstrip line 31 is $Z_1$, impedance of the ridged waveguide section 36 is $Z_2$, impedance of the λ/4 matching box 7 is $Z_3$, and impedance of the standard waveguide 32 is $Z_4$. When it is attempted to connect the microstrip line 31 with the standard waveguide 32, if line matching only is taken into consideration, the reflection coefficient is the smallest when the characteristic impedance increases, e.g., from $Z_1$ to $Z_4$ (or decreases, e.g., from $Z_4$ to $Z_1$) in the connection sequence. In other words, if line matching only is taken into consideration, the impedances have the magnitude relationship of inequality (3):

$$Z_1<Z_2<Z_3<Z_4 \tag{3}$$

On the other hand, we have discovered that in transmission the line conversion between the TEM waves of the microstrip line and TE01 waves of the waveguide, if the cross-sections are substantially of the same size, the electromagnetic wave distribution of the TEM waves of the microstrip line is equivalent to the electromagnetic wave distribution of the TE01 waves around the ridges of the ridged waveguide, and the line conversion loss decreases.

Based on this observation, FIG. 2 shows a line transducer (hereafter, transmission mode transducer) connecting the ridged waveguide with a microstrip line at right angles.

The microstrip line is open on its main line upper surface. When the cross-sections of the microstrip line and ridged section of the ridged waveguide are of substantially the same size, since the ridged waveguide is surrounded by metal shielding, the capacitance component of the rectangular part of the waveguide cross-section, except around the ridges, reduces the impedance when the cut-off frequency of the waveguide is reduced, so the characteristic impedance becomes lower than that of the microstrip line.

Figure 3:
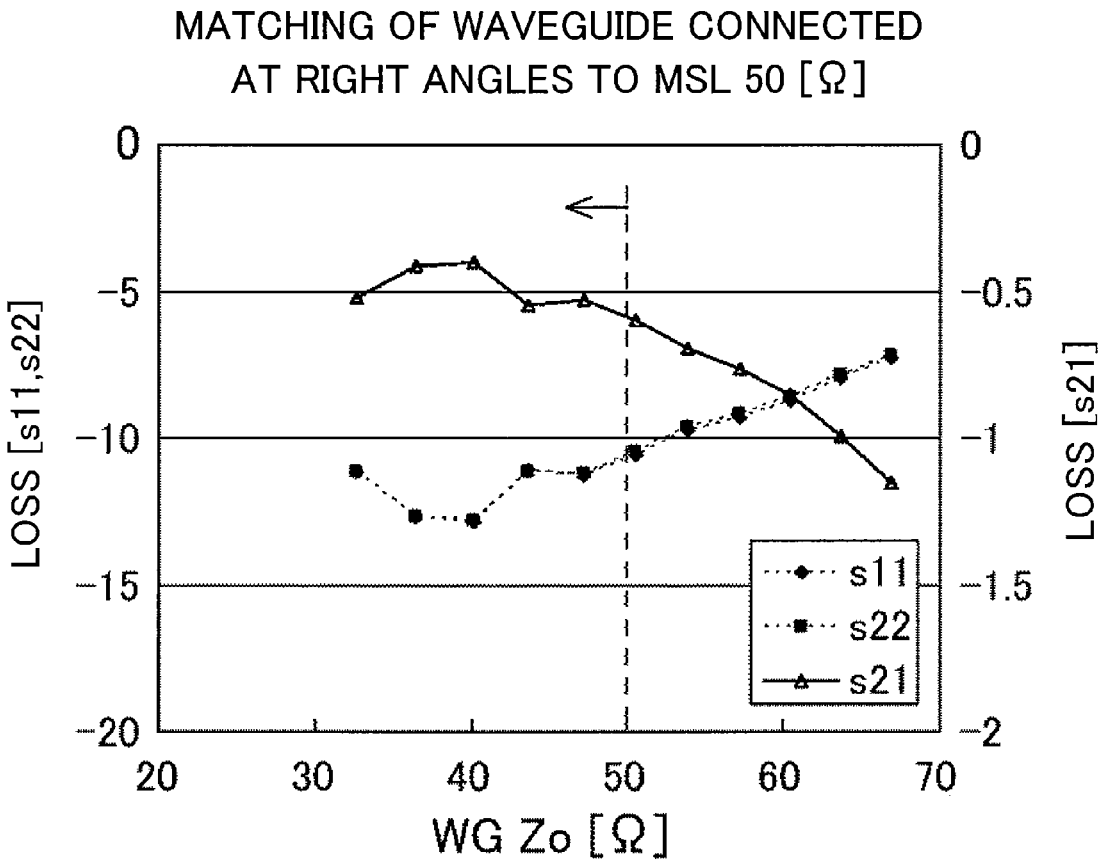
FIG. 3 is a diagram showing the frequency characteristics of a transmission mode transducer according to the present invention.

FIG. 3 shows calculation results for the frequency characteristics of the transmission mode transducer according to the present invention. FIG. 3 also shows the frequency characteristics of the transmission mode transducer 6. The horizontal axis (WG $Z_O$ [Ω]) represents the characteristic impedance of the waveguide and the vertical axis represents the loss. $S_{11}$, $S_{22}$, and $S_{21}$ represent S-parameter plots for portions of the waveguide. It will be assumed that the characteristic impedance of the microstrip line is designed to be 50Ω taking account of matching with other circuits and components. As will be appreciated from FIG. 3, in a construction wherein the microstrip line 31 is connected with the ridged waveguide 36 at right angles, if the cross-sections of the microstrip line and ridges of the ridged waveguide are substantially the same size, i.e., when the characteristic impedance of the ridged waveguide is 40Ω, it becomes the minimum value. Specifically, as regards the line transducer between the ridged waveguide 36 and the microstrip line 31, it will be appreciated from the calculation result of FIG. 3 that when the characteristic impedance of the microstrip line is 50Ω and the characteristic impedance of the ridged waveguide section 36 is 40Ω, the reflection characteristic becomes the minimum value.

Therefore, when converting from the TE01 transmission mode of the waveguide to the TEM transmission mode of the microstrip line, minimization of the line loss can be expected by interposing a waveguide having a lower impedance than that of the microstrip line.

Therefore, we have discovered that for a waveguide which is a contact point with the microstrip line, it is desirable to reduce the characteristic impedance of the waveguide lower than that of the microstrip line, the optimum value being about 80% (70 to 90%). This gives the same results when the waveguide and microstrip line are connected at right angles (FIG. 2), and is applied in the transmission mode transducer 6 of the invention. Therefore, the impedance $Z_2$ of the ridged waveguide 36 in the transmission mode transducer 6 is a lower impedance than that of the microstrip line 31, and the magnitude relationship of inequality (4) holds.

$$Z_2 \leqq Z_1<Z_3<Z_4 \tag{4}$$

To satisfy inequality (4), in the ridged waveguide 36 in FIGS. 1A and 1B, the size of the ridges 36*a*, 36*b* is specified. Specifically, the length $W_h$ (FIG. 1B) in the long direction of the ridged waveguide cross-section of the ridge 36*a* connected with the microstrip line 31 via the via 35, is arranged to be twice or less than twice the microstrip line width $W_S$ (FIGS. 1B, 2), the length $W_L$ FIG. 1B) in the long direction of the ridged waveguide section of the ridge 36*b* of the electrically conductive conductor 34 that functions as a ground (GND) electrode of the microstrip line, is arranged to be three times or more than three times the microstrip line width, the gap $W_R$ of the ridged opening is arranged to be twice or less than twice the thickness $M_{SLts}$ of the dielectric 33, and the length $W_L$ of the ridged cross-section 36 is arranged to be $\lambda/16$ or less. Since the impedance as seen from the $\lambda/4$ matching box 7 becomes closer to the value of the microstrip line when the phase rotation due to millimeter wave transmission in the ridged waveguide section 36 becomes small, matching with the $\lambda/4$ matching box 7 is improved.

In other words, from the result of FIG. 3, in order to reduce the characteristic impedance, in the construction of the ridged waveguide 36 in the transmission mode transducer 6, it is preferable that the ridge 36*a* connected with the microstrip line 31 via the via 35, has a length $W_h$ in the lengthwise direction of the ridge waveguide cross-section which is twice or less than twice that of the microstrip line width $W_S$, that the ridge 36*b* which functions as the ground electrode of the microstrip line has a length $W_L$ which is three times or more than three times the microstrip line width $W_S$, and that the gap $W_R$ between ridges is twice or less than twice that of the thickness $M_{SLts}$ of the dielectric 33 (via 35).

According to this embodiment, in the line conversion between the microstrip line and the waveguide, the loss which arises during transmission mode conversion between the TEM waves of the microstrip line and the waveguide TM01 mode waves is reduced by interposing a transmission mode transducer having a ridged waveguide section of lower impedance than that of the microstrip line.

Second Embodiment

Figure 4:
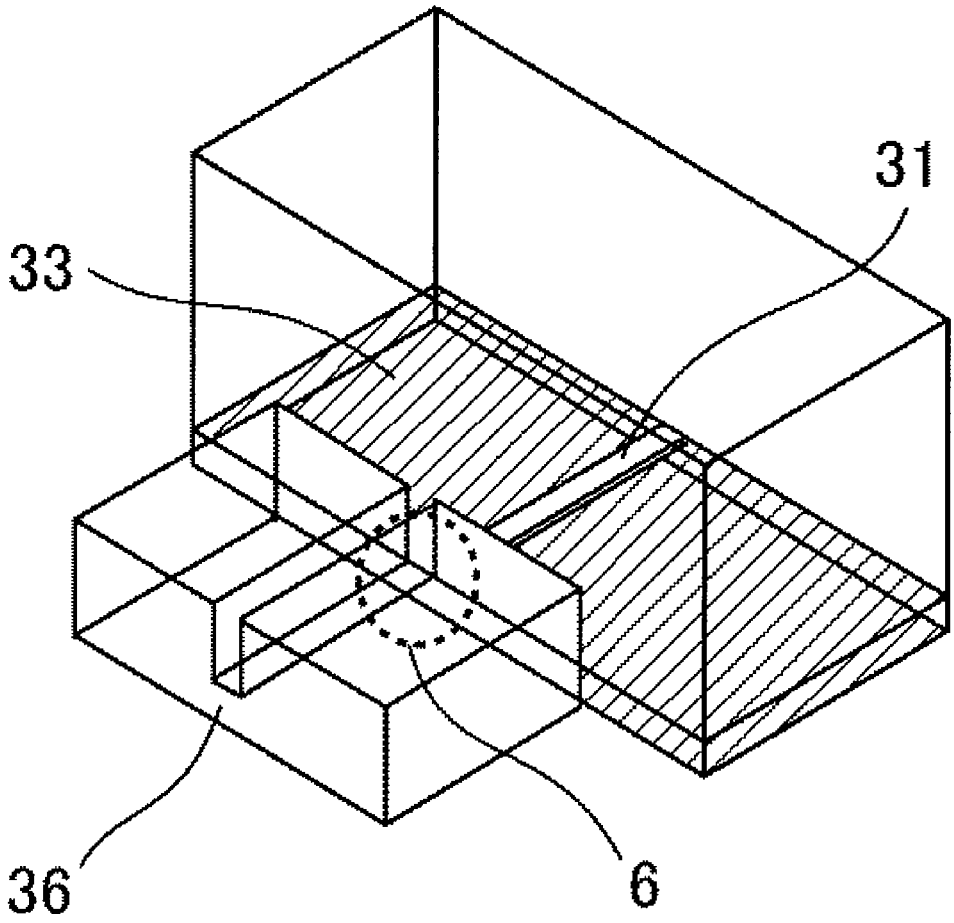
FIG. 4 is a diagram showing a waveguide structure according to a second embodiment of the present invention.
Figure 5:
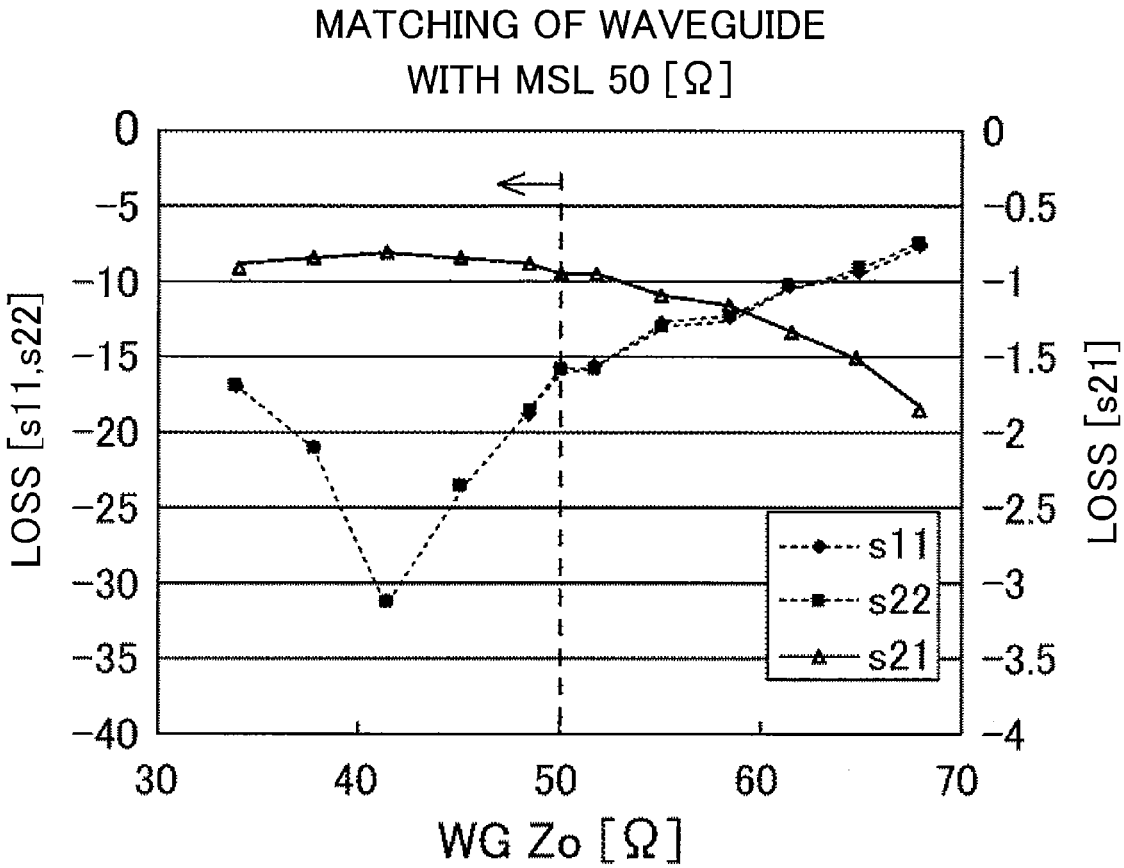
FIG. 5 is a diagram showing the frequency characteristics of the waveguide shown in FIG. 4.

FIG. 4 shows a second embodiment of the waveguide structure of the present invention wherein a ridged waveguide and a microstrip line are connected horizontally. FIG. 5 shows the frequency characteristics of the waveguide structure wherein the 50Ω microstrip line and waveguide shown in FIG. 4 are connected horizontally.

FIG. 4 shows the waveguide structure wherein the waveguide is connected with the microstrip line. Reference numeral 31 is the microstrip line, reference numeral 33 is a dielectric substrate for forming the microstrip line, and reference numeral 36 is a ridged waveguide. The transmission mode transducer 6 in this embodiment, to convert from the TE01 transmission mode of the ridged waveguide 36 to the TEM transmission mode of the microstrip line, connects the ridge ends of the ridged waveguide 36 with the main line of the microstrip line 31. To satisfy the relation of equation (4), the characteristic impedance (Z2) of the waveguide transducer (ridged waveguide 36) is equal to or less than the characteristic impedance (Z1) of the microstrip line 31.

FIG. 5 shows the frequency characteristics of the transmission mode transducer 6 connecting the 50Ω microstrip line and the waveguide shown in FIG. 4. The horizontal axis (WG Zo [Ω]) is the characteristic impedance of the waveguide, and the vertical axis is the loss. $S_{11}$, $S_{22}$, and $S_{21}$ represent S-parameter plots for portions of the waveguide. We have discovered that in the transmission mode line conversion between TEM waves of the microstrip line and the TE01 waves of the waveguide, if the cross-sections are substantially the same size, the electromagnetic wave distribution of the TEM waves of the microstrip line and the electromagnetic wave distribution of the TE01 waves around the ridges of the ridged waveguide become equivalent, and the line conversion loss then becomes smaller. The microstrip line is open on its main line side upper surface. When the cross-sections of the microstrip line and ridged section of the ridged waveguide are of substantially the same size, since the circumference of the ridged waveguide is shielded with metal, the capacitance component in the rectangular part of the waveguide cross-section, except around the ridges, causes the impedance to drop when the cut-off frequency of the waveguide is reduced, and the characteristic impedance becomes lower than that of the microstrip line. Therefore, from FIG. 5, it is seen that the characteristic impedance of the waveguide falls from 50Ω to the minimum value of about 40Ω.

Hence, it is preferred that the length in the long direction of the cross-section of the ridged waveguide 36 in the transmission mode transducer which is connected horizontally, is twice or less than twice the width of the microstrip line 31, and the ridged gap is twice or less than twice the thickness of the dielectric 33 forming the microstrip line.

According to this embodiment, in the line transducer between the microstrip line and waveguide, loss arising during transmission mode conversion between TEM waves of the microstrip line and waveguide TM01 mode waves is reduced by interposing the transmission mode transducer which is connected horizontally having a ridged waveguide section of lower characteristic impedance than that of the microstrip line.

Third Embodiment

Figure 6:
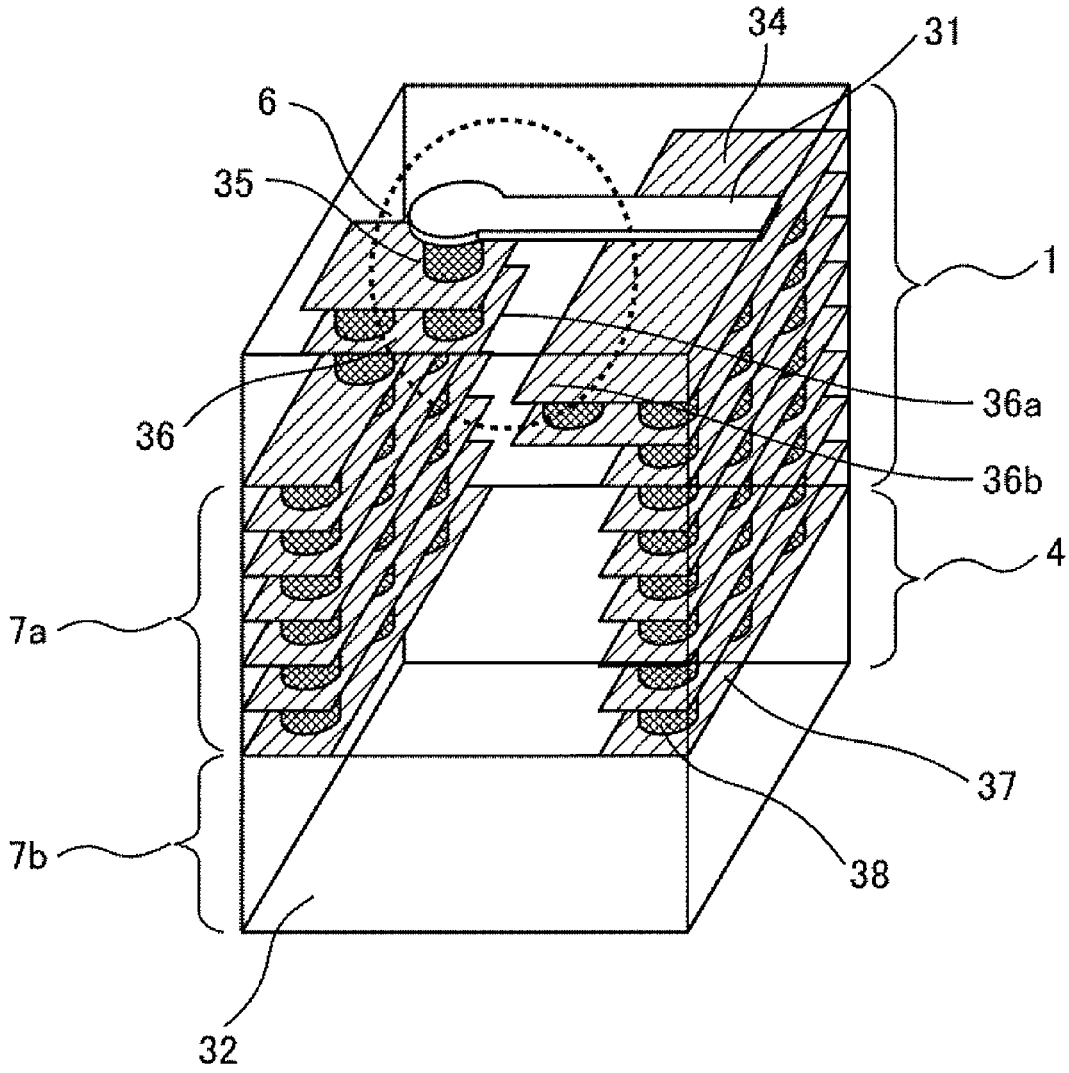
FIG. 6 is a diagram showing a waveguide structure according to a third embodiment of the present invention.

A third embodiment of the line transducer of a microstrip line and waveguide, according to the waveguide structure of the present invention, will now be described referring to FIG. 6. FIG. 6 is a perspective view of the waveguide structure.

In this embodiment, the transmission mode transducer 6 and $\lambda/4$ matching box 7*a* manufactured from a multilayer substrate, are formed in a waveguide shape extending through to the undersurface of the multilayer substrate by alternately laminating a dielectric film and a metal conductor film, patterning a hollow shape or I shape in the metal conductor films, and electrically connecting the metal conducting films by way of vias 35, 38. In this example, the multilayer substrate includes nine dielectric layers. Reference numeral 6 is the transmission mode transducer formed on the multilayer substrate 1, and reference numeral 7*a* is the $\lambda/4$ matching box formed from an artificial-waveguide on the multilayer substrate 1. Reference numeral 7*b* is a $\lambda/4$ matching box provided in a heat transfer plate 4. Reference numeral 31 is the main line of the microstrip line manufactured on one surface of the multilayer substrate, reference numeral 32 is a standard waveguide, reference numeral 34 is an electrically conductive conductor manufactured from metal patterns and vias on the multilayer substrate 1, reference numeral 35 is a via connecting the ridge 36*a* of the ridged artificial-waveguide section 36 of the electrically conductive conductor 34 with the microstrip line 31, and reference numeral 36 is a artificial-ridged waveguide section that mimics a ridged waveguide and is part of the electrically conductive conductor. The ridge 36*a* of the ridged waveguide section is connected to the microstrip line 31 by means of the via 35, and the ridge 36*b* functions as the GND conductor of the microstrip line 31. A metal pattern 37 forming the electrically conductive conductor is substantially rectangular, and has a hollow or I-shaped notch. The vias 35 formed on the multilayer substrate 1 may be one or an odd number of vias disposed so as not to interfere with the current flowing along the strong field of the transmission mode TE01 of the ridged waveguide. The λ/4 matching box 7 (7*a*, 7*b*) is used to match the characteristic impedance of the ridged waveguide section 36 of the transmission mode transducer 6 with the standard waveguide 32.

According to this embodiment, in the line conversion between the microstrip line and the waveguide, the loss which arises during transmission mode conversion between the TEM waves of the microstrip line and the waveguide TM01 mode waves is reduced by interposing a transmission mode transducer having a ridged waveguide section of lower impedance than that of the microstrip line.

Fourth Embodiment

Figure 7:
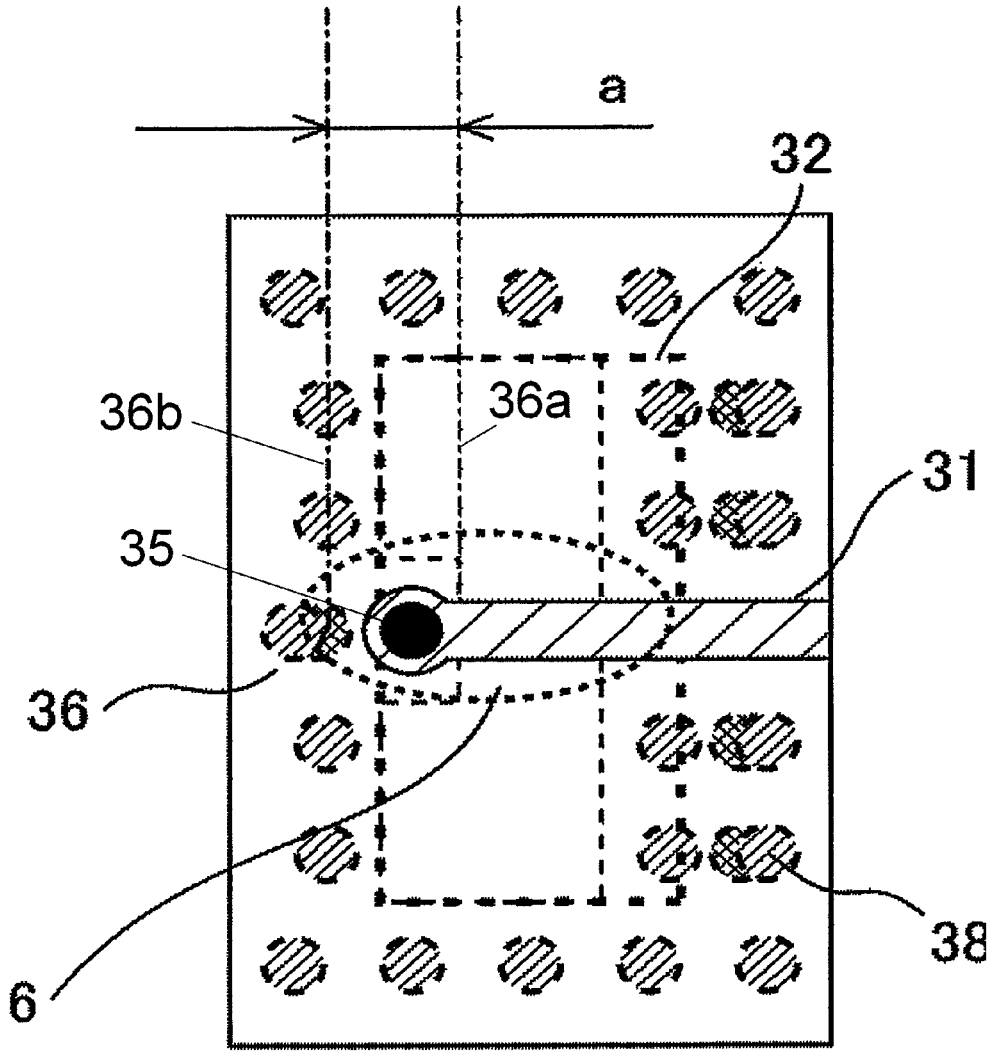
FIG. 7 is a diagram showing a waveguide structure according to a fourth embodiment of the present invention.

FIG. 7 shows a fourth embodiment of the transmission mode transducer between the microstrip line and waveguide having the waveguide structure according to the invention. FIG. 7 corresponds to an upper plan view of the waveguide structure shown in FIG. 6.

As discussed earlier item 6 is the transmission mode transducer, item 32 is a standard waveguide, and item 36 is the ridged waveguide section.

Not explicitly shown in FIG. 7, vias 38 are disposed between layers in order to share the potential of the metal pattern 37 of each layer of the multilayer substrate 1. The distance 'a' of the ridges 36, from their projecting ends 36*a* to the virtual GND surface 36*b* of the rectangular artificial-waveguide is suppressed to be less than λ/4 so that standing waves are not formed in the ridges. The vias 38 in the ridged waveguide section 36 are part of the electrically conductive conductor 34, these vias being provided in the ridge projection direction. The ridged waveguide section 36 and λ/4 matching box are formed by patterning a hollow or I-shaped notch in the metal pattern 37 of the multilayer substrate 1, the vias 38 interconnecting the metal layers.

The waveguide structure of this embodiment is a structure wherein the microstrip line 31, dielectric substrate 33, and electrically conductive conductor 34 in FIG. 4 are formed on the multilayer substrate 1.

According to this embodiment, in the line conversion between the microstrip line and the waveguide, the loss that arises during transmission mode conversion between the TEM waves of the microstrip line and the TM01 mode waves of the waveguide is reduced by interposing a transmission mode transducer having a ridged waveguide section of lower impedance than that of the microstrip line.

Fifth Embodiment

Figure 8:
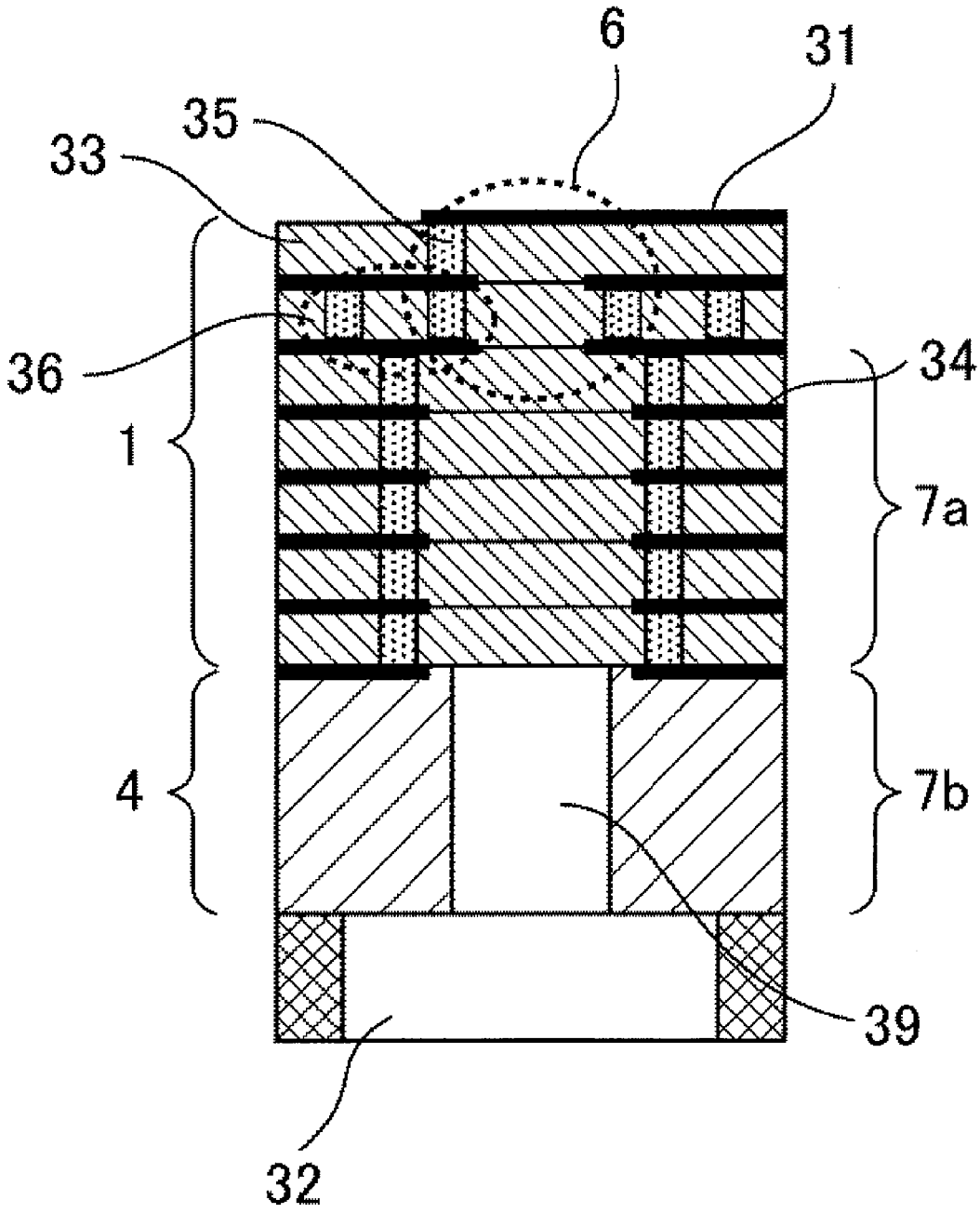
FIG. 8 is a diagram showing a waveguide structure according to a fifth embodiment of the present invention.
Figure 9:
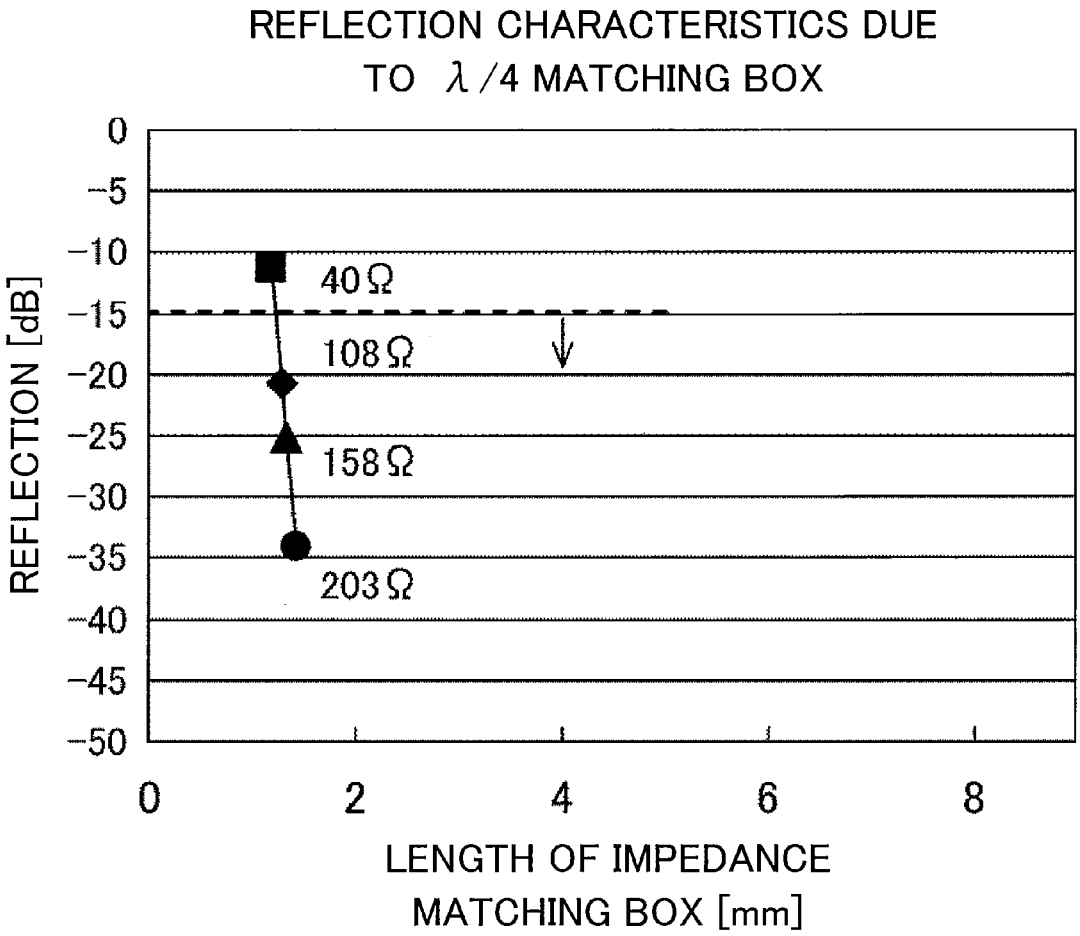
FIG. 9 is a diagram showing the reflective characteristics of a line transducer using a λ/4 transducer.

FIGS. 8 and 9 show a fifth embodiment of the invention. As discussed earlier, item 31 is a microstrip line, item 33 is a dielectric, item 34 is an electrically conductive conductor, and item 35 is a via. Item 39 is a non-filled portion of λ/4 matching box 7*b*.

FIG. 8 shows a vertical cross-section of the line transducer of this embodiment. The waveguide structure of this embodiment includes the multilayer substrate 1, the heat transfer plate 4, the transmission mode transducer 6, λ/4 matching boxes 7*a*, 7*b*, the standard waveguide 32 and the low impedance ridged waveguide 36. The transmission mode transducer 6 having the low impedance ridged waveguide section 36 and the λ/4 matching box 7*a* are formed on the multilayer substrate 1. The λ/4 matching box 7*b*, formed of an electrically conductive conductor having a lower impedance than that of the standard waveguide 32 which constitutes the input/output terminals, and a higher impedance than that of the λ/4 matching box 7*a* on the multilayer substrate 1, is formed in the heat transfer plate 4.

An essential feature of this embodiment is that waveguide structure is formed from the transmission mode transducer 6 having a ridged waveguide section of lower impedance than the microstrip line 31 formed on the multilayer substrate 1, and the λ/4 matching box 7*a* which is an artificial-waveguide formed on the multilayer substrate 1.

FIG. 9 shows calculation results for reflection characteristics associated with the λ/4 matching box. The horizontal axis represents the length of the impedance matching box (in mm) and the vertical axis represents the reflection loss (in dB). The diagram shows the results of a simulation using four characteristic impedances (i.e., 40Ω, 108Ω, 158Ω, and 203Ω). As shown in FIG. 9, from the 40Ω ridged waveguide section 36 to the 380Ω standard waveguide 32, when impedance conversion is performed using a single λ/4 transducer (the impedance of the λ/4 transducer input terminal is 40Ω), the reflection loss is about −12 dB. When the impedance of the λ/4 transducer input terminal, wherein the impedance ratio of the input/output terminals of the λ/4 matching box is 4 (≈380Ω/100Ω) or less, is 100Ω, a λ/4 matching box giving a good reflected loss can be realized. According to this embodiment, the length of the matching box giving the desired reflection loss is about 1.2 mm. The length of the λ/4 matching box 7*a* formed on the multilayer substrate 1 is 1.2 mm/√ (dielectric constant of multilayer substrate 1).

Since the impedance ratio of the ridged waveguide section 36 and standard waveguide 32 is about 9 (√380Ω/40Ω), by connecting the two λ/4 matching boxes 7*a*, 7*b* having an impedance ratio at the input/output terminals of about 3, in series, impedance conversion between the ridged waveguide section 36 and the standard waveguide 32 can be realized with low loss.

The characteristic impedance of the λ/4 matching box 7*a* when it is directly connected to a 50Q microstrip line is designed to be 70Ω (≈√(100*50)). When the ridged waveguide section of low impedance forming the transmission mode transducer 6 which is a characteristic feature of the invention, is inserted at the input terminal of the λ/4 matching box 7*a*, from the result of FIG. 3, the passband loss accompanying transmission mode conversion from the microstrip line to the waveguide, can be expected to improve by about 0.6 dB from 1.2 dB@70Ω to 0.4 dB@40Ω. Although the impedance ratio of the λ/4 matching box 7*a* input/output terminals varies from 2 to 2.5, it is still three times or less than three times the design specification of the λ/4 matching box, so the increase of reflection loss is minimized. Therefore, there is a large effect obtained by inserting the ridged waveguide section of the impedance forming the transmission mode transducer 6, and assembly loss due to the waveguide structure as a whole can easily be reduced. The same effect can also be obtained even in the case of a single λ/4 matching box, and it is therefore an important technique for connecting from a microstrip line to a waveguide.

According to this embodiment, in the line conversion between the microstrip line and the waveguide, the loss which arises during transmission mode conversion between the TEM waves of the microstrip line and the waveguide TM01 mode waves is reduced by interposing a transmission mode transducer having a ridged waveguide section of lower impedance than that of the microstrip line.

Sixth Embodiment

A sixth embodiment of the waveguide structure of the invention will now be described referring to FIG. 10 to FIG. 12.

This embodiment, by combining a tapered impedance matching box with a λ/4 matching box, increases the width of the passband.

Figure 10:
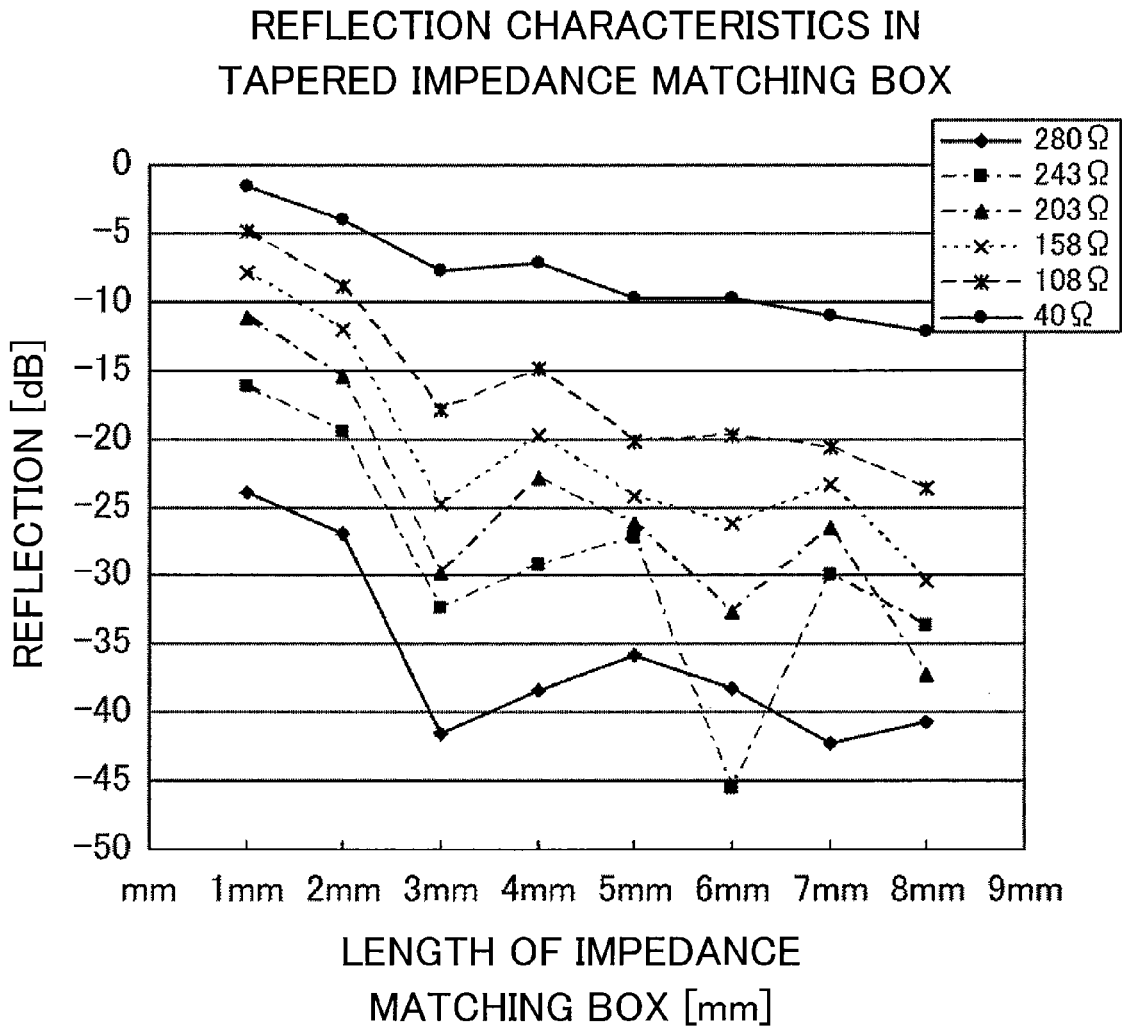
FIG. 10 is a view showing the reflective characteristics of a tapered impedance transducer of a metal waveguide.

FIG. 10 shows the reflection loss of a tapered impedance transducer of a metal waveguide. The horizontal axis shows the line length of the tapered impedance transducer, and the vertical axis shows the reflection loss of the impedance transducer. The characteristic impedance of the tapered impedance transducer input terminal opening cross-section is swept from 40Ω to 280Ω (i.e., FIG. 10 shows plottings for opening cross-sections of 40Ω, 108Ω, 158Ω, 203Ω, 243Ω, and 280Ω). The characteristic impedance of the output terminal opening cross-section is assumed to be 380Ω.

It is seen that, compared with the reflective characteristics of the line transducer using the λ/4 matching box shown in FIG. 9, the length of the matching box to obtain the desired reflection loss is considerably longer for the tapered transducer. It is also seen that when using a tapered transducer, reflection loss can be suppressed by increasing the characteristic impedance of the input terminal opening and the transducer line is made long to about 6 mm.

Figure 11:
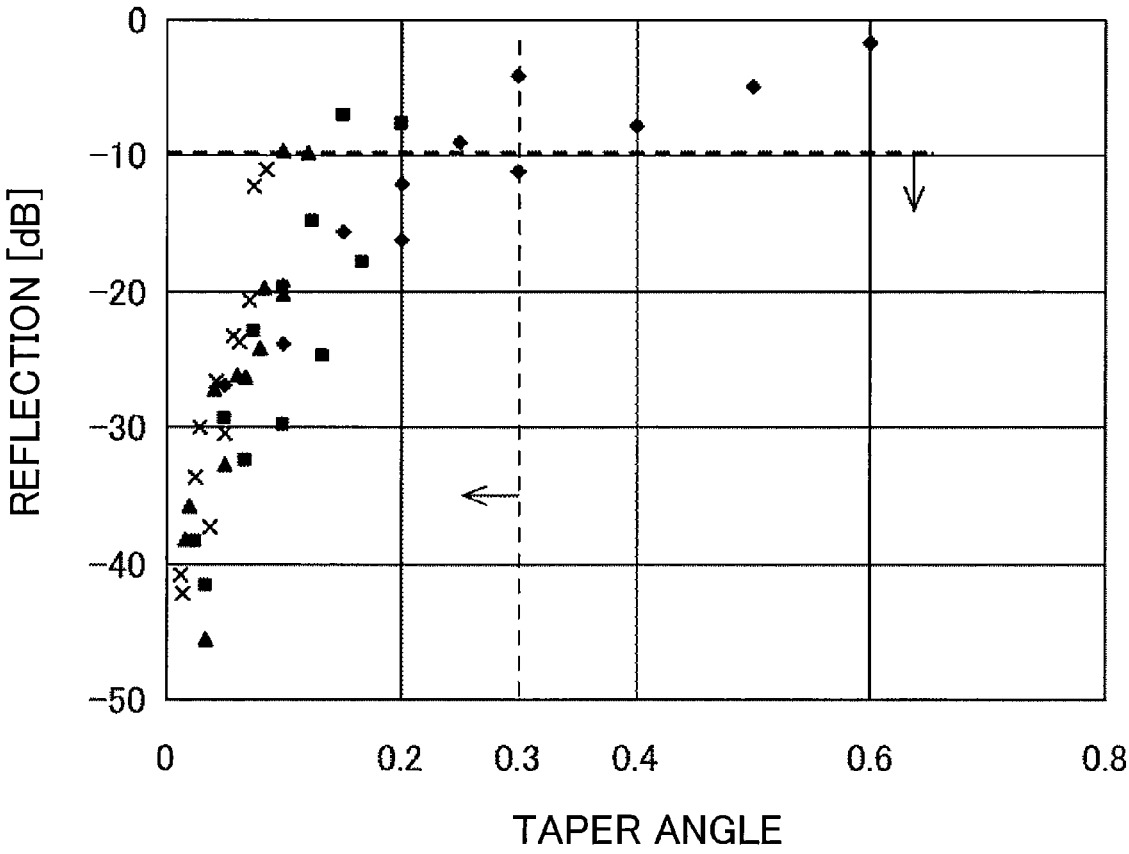
FIG. 11 is a diagram showing the reflective characteristics of FIG. 10 normalized by the taper angle of the impedance transducer.

FIG. 11 shows the reflective characteristics in FIG. 10 normalized by the taper angle of the impedance transducer. The taper angle of the horizontal axis=(the difference of the length of the short side of the input/output waveguide cross-section)/(the length of the tapered impedance transducer). It is seen that when the angle is 0.1 (angle $5.7°=\tan^{-1}(0.1)$), the reflection loss is −20 dB or less which is satisfactory, but if the taper angle is changed to 0.3, the reflection loss worsens to −10 dB. When the impedance transducer is designed to have an angle of 0.1 or less (the input/output terminal impedance ratio of the impedance transducer is about 1.5), the reflection loss is about −15 dB or less, and it is seen that provided the angle is 0.3 or less (input/output terminal impedance ratio of the impedance transducer is about 2), the reflection loss is about −11 dB or less, which is a usable value.

Figure 12:
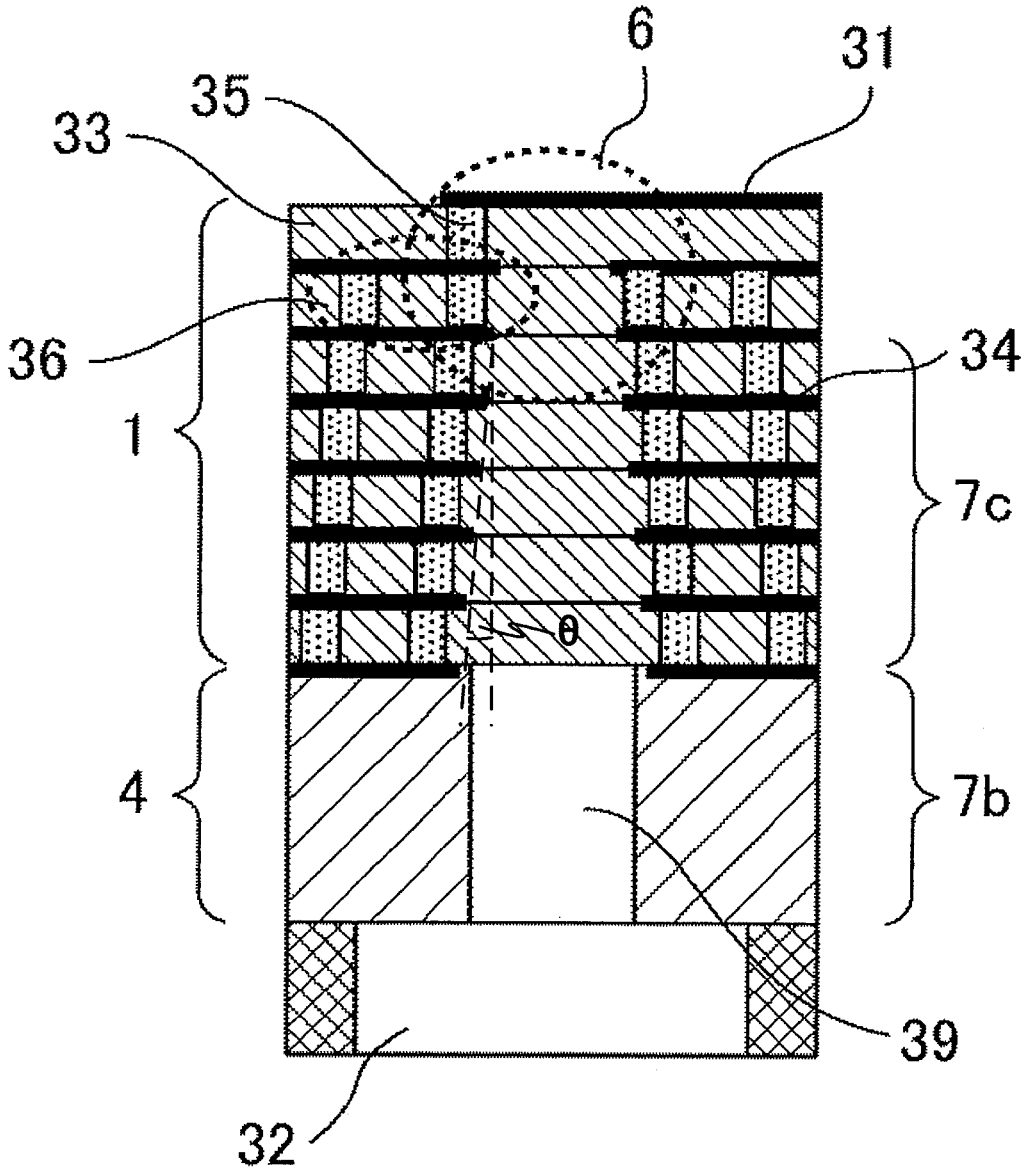
FIG. 12 is a vertical cross-section of a sixth embodiment of the present invention using a tapered impedance transducer.

FIG. 12 is a vertical cross-section of the sixth embodiment of the waveguide structure using a tapered impedance transducer 6. Also shown in FIG. 12 is microstrip line 31, dielectric 33, and via 35. According to this embodiment, the waveguide structure includes at least a multilayer substrate, a λ/4 matching box, and the transmission mode transducer. An impedance matching box such as a λ/4 matching box having a characteristic impedance ratio of 3 or less at the input/output terminals, is provided the multilayer substrate 1. According to this embodiment, instead of the λ/4 matching box 7*a* found in earlier embodiments, an impedance matching box 7*c* including a tapered artificial-waveguide having a length of λ/4 or less with a taper angle θ satisfying the relation $\tan(\theta)/(\sqrt{(Er)})<0.3$, which has a reflection characteristic of −10 dB or less, is used on the multilayer substrate.

Specifically, the transmission mode transducer 6 having a ridged waveguide section 36 of low impedance and a tapered impedance matching box 7*c*, are provided on the multilayer substrate 1. The λ/4 matching box 7*b* having a lower impedance than that of the standard waveguide 32 and a higher impedance than that of the tapered impedance matching box 7*c*, is provided in the heat transfer plate 4. The λ/4 matching box 7*b* is filled with a dielectric material 39 of different dielectric constant from that used on the multilayer substrate 1. In the tapered impedance matching box 7*c* provided on the multilayer substrate 1 having a dielectric constant Er, the line length is compressed by √Er, and the taper angle is enlarged by √Er times.

As shown in FIG. 12, by shifting the position of the via disposed on the multilayer substrate from the ridged waveguide section 36 to the waveguide 32, and shifting the via position within a range equal to or less than a dielectric single layer thickness h*√(Er)*0.1, the wideband tapered impedance matching box 7*c* having a reflection loss of −15 dB or less, can be manufactured. Moreover, even if the length of the tapered impedance matching box is not exactly λ/4, good electrical characteristics can still be obtained, and even if there is a dielectric constant fluctuation or thickness error on the multilayer substrate, the fluctuation of electrical characteristics may be expected to be small.

According to this embodiment, in the line conversion between the microstrip line 31 and the waveguide 32, the loss which arises during transmission mode conversion between the TEM waves of the microstrip line and the waveguide TM01 mode waves is reduced, and the passband is widened, by interposing a transmission mode transducer having a ridged waveguide section of lower impedance than that of the microstrip line.

Seventh Embodiment

Figure 13:
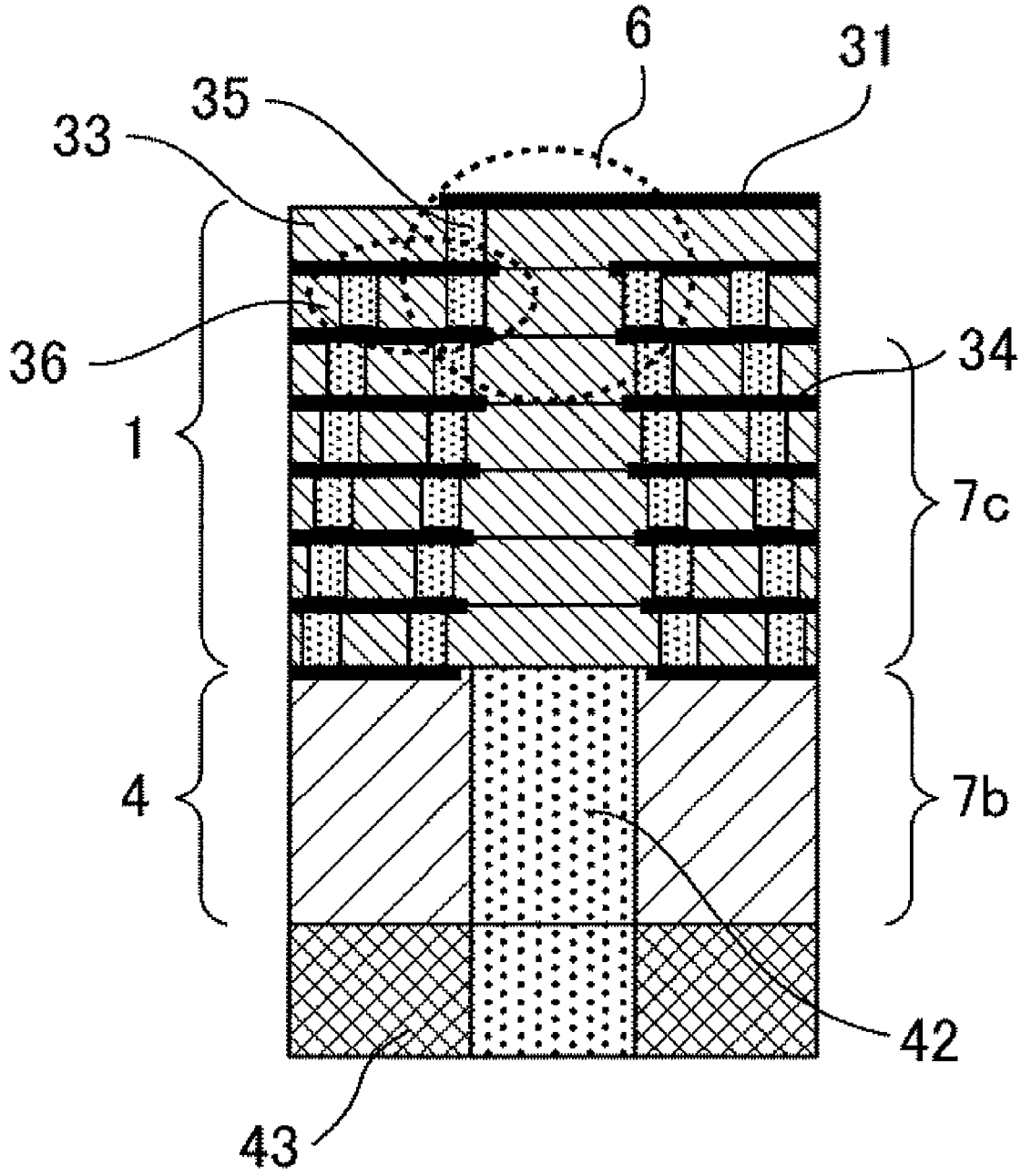
FIG. 13 is a vertical cross-section of a seventh embodiment of the present invention using a tapered impedance transducer.
Figure 14:
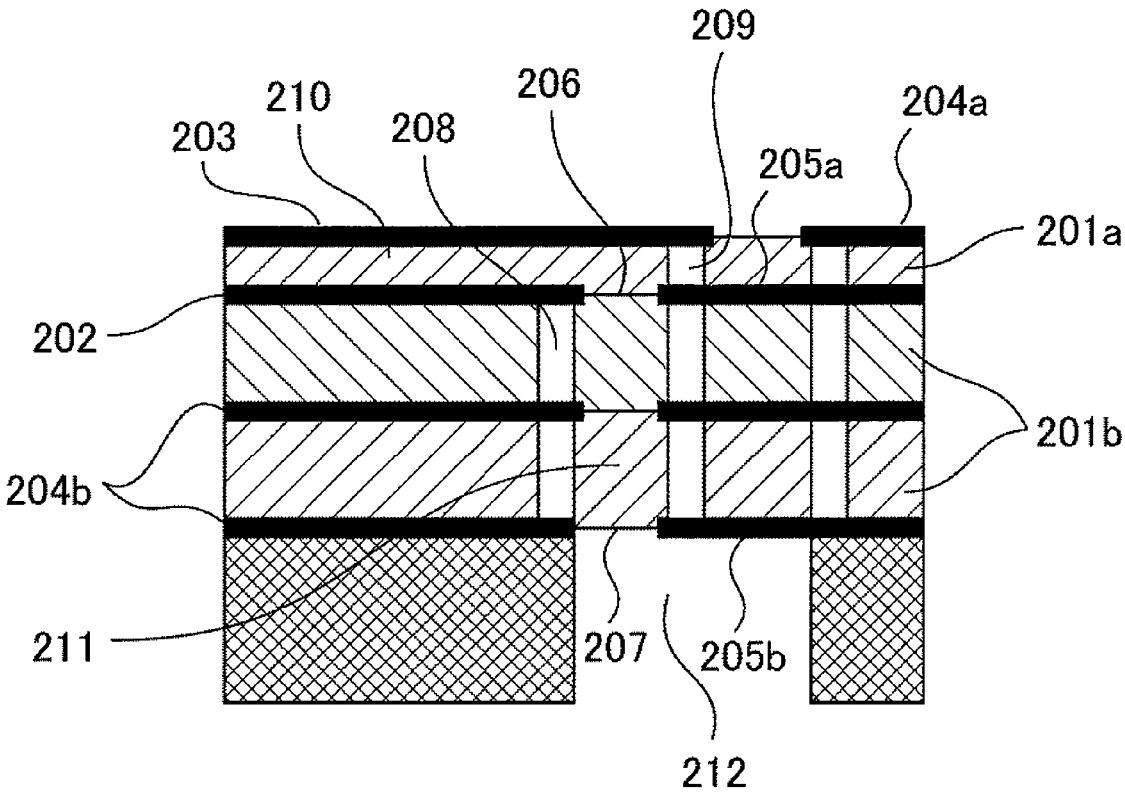
FIG.14 (PRIOR ART)
FIG. 14 is a diagram showing a first example of a waveguide/microstrip line transducer according to the conventional technology.
Figure 15:
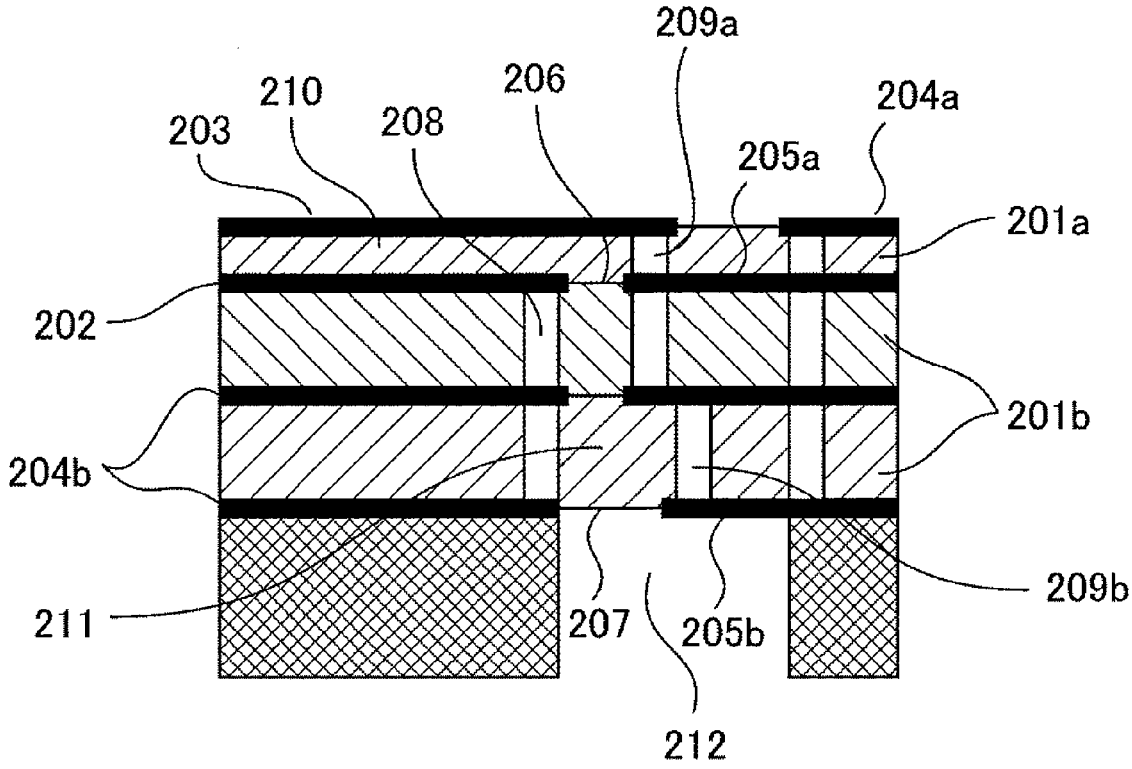
FIG.15 (PRIOR ART)
FIG. 15 is a diagram showing a second example of a waveguide/microstrip line transducer according to the conventional technology.

FIG. 13 is a vertical cross-section showing a seventh embodiment of a waveguide structure using a tapered impedance transducer. The waveguide structure of this embodiment includes multi-layer substrate 1, heat transfer plate 4, and transmission mode transducer 6. Also shown in FIG. 13 is microstrip line 31, dielectric 33, and via 35. The transmission mode transducer 6 and tapered impedance matching box 7*c* having the ridged waveguide section 36 of low impedance are provided on the multilayer substrate 1. As with FIG. 12, the λ/4 matching box 7*b* having a lower impedance than that of the standard waveguide 32 used in earlier embodiments and higher impedance than that of the tapered impedance matching box 7*c* is provided in the heat transfer plate 4. The λ/4 matching box 7*b* is filled with a dielectric material having a different dielectric constant from that used on the multilayer substrate 1.

Reference numeral 42 is a waveguide of the λ/4 matching box 7*b* filled with a dielectric material different from air. Reference numeral 43 is a waveguide which constitutes the input/output terminals of the antenna 3, and it is filled with a dielectric material different from air. By filling the interior of the waveguides 42, 43 with a dielectric material, the characteristic impedance of the waveguides 42, 43 is reduced. If the impedance of the waveguide 43 of the antenna 3 is made small, the impedance ratio with the microstrip line 31 is suppressed, and if the impedance ratio is 3 or less, an assembly which satisfies the loss specification of the transceiver can be achieved with one λ/4 matching box 7.

What is claimed is:

1. A waveguide structure comprising:

a microstrip line;

a waveguide; and a transmission mode transducer provided between the microstrip line and the waveguide, wherein the transmission mode transducer comprises a waveguide transducer, wherein the waveguide transducer is a ridged waveguide, wherein a characteristic impedance of the waveguide transducer is equal to or less than a characteristic impedance of the microstrip line, wherein a length of a shorter side of a rectangular cross-section opening of the ridged waveguide is twice or more than twice a thickness of a dielectric of the microstrip line, and wherein a ridge is provided near a center of one or both long sides of the ridged waveguide rectangular cross-sectional opening, projecting toward the center of the rectangular opening, wherein a distance from the ridge to the nearest part of the rectangular opening is twice or less than twice the thickness of the dielectric.

2. The waveguide structure according to claim 1, wherein the ridged waveguide is formed of ridges projecting near a center of one or both long sides of the rectangular cross-sectional opening of the ridged waveguide, and the ridged waveguide having a characteristic impedance less than that the characteristic impedance of the microstrip line, wherein the ridged waveguide is formed in a multilayer substrate of alternately laminated dielectric and metal conductor films, wherein a length of a ridged section comprised of the ridges is λ/4 or less from a face of the long sides of the rectangular cross-sectional opening of the ridged waveguide, and wherein a plurality of electrically conducting vias are disposed in a projection direction in the multilayer substrate.

3. A waveguide structure comprising:

a microstrip line;

a waveguide; and a transmission mode transducer provided between the microstrip line and the waveguide, wherein the transmission mode transducer comprises a waveguide transducer, wherein the waveguide transducer is a ridged waveguide, wherein a characteristic impedance of the waveguide transducer is equal to or less than a characteristic impedance of the microstrip line, and wherein a length of a shorter side of a rectangular cross-sectional opening of the ridged waveguide is twice or more than twice a thickness of a dielectric of the microstrip line, the microstrip line further comprising:

an RF circuit; and a λ/4 matching box connected between the waveguide and the waveguide transducer, wherein the waveguide structure constitutes input/output terminals for externally connecting the waveguide structure, wherein the microstrip line constitutes a millimeter waveband data line of the RF circuit, and wherein a characteristic impedance of the λ/4 matching box is an intermediate value between the characteristic impedance of the microstrip line and a characteristic impedance of the waveguide.

4. The waveguide structure according to claim 3, further comprising:

a multilayer substrate;

an RF circuit board, wherein the RF circuit is provided on a top layer of the RF circuit board and the multilayer substrate, wherein the waveguide transducer and the λ/4 matching box are provided in an inner layer of the multilayer substrate, and wherein the transmission mode transducer connects the microstrip line to the waveguide transducer at a right angle.

5. A waveguide structure comprising:

a microstrip line;

a waveguide; and a transmission mode transducer provided between the microstrip line and the waveguide, wherein the transmission mode transducer comprises a waveguide transducer, wherein the waveguide transducer is a ridged waveguide, wherein a characteristic impedance of the waveguide transducer is equal to or less than a characteristic impedance of the microstrip line, and wherein the microstrip line is connected to the waveguide transducer at a right angle, the waveguide structure further comprising:

an RF circuit; and a λ/4 matching box connected between the waveguide and the waveguide transducer, wherein the waveguide structure constitutes input/output terminals for externally connecting the waveguide structure, wherein the microstrip line constitutes a millimeter waveband data line of the RF circuit, and wherein a characteristic impedance of the λ/4 matching box is an intermediate value between the characteristic impedance of the microstrip line and a characteristic impedance of the waveguide.

6. The waveguide structure according to claim 5, further comprising:

a multilayer substrate; and an RF circuit board, wherein the RF circuit is provided on a top layer of the RF circuit board and the multilayer substrate, wherein the waveguide transducer and the λ/4 matching box are provided in an inner layer of the multilayer substrate, and wherein the transmission mode transducer connects the microstrip line to the waveguide transducer at a right angle.

7. The waveguide structure according to claim 5, wherein the ridged waveguide is formed of ridges projecting near a center of one or both long sides of a rectangular cross-sectional opening of the ridged waveguide, and the ridged waveguide having a characteristic impedance less than that the characteristic impedance of the microstrip line, wherein the ridged waveguide is formed in a multilayer substrate of alternately laminated dielectric and metal conductor films, wherein a length of a ridged section comprised of the ridges is λ/4 or less from a face of the long sides of the rectangular cross-sectional opening of the ridged waveguide, and wherein a plurality of electrically conducting vias are disposed in a projection direction in the multilayer substrate.

8. A waveguide structure, comprising:

a multilayer substrate; and a heat transfer plate laminated on the multilayer substrate;

wherein, on the multilayer substrate are provided, a microstrip line, a transmission mode transducer connected between the microstrip line and a waveguide, and a first λ/4 matching box, wherein the transmission mode transducer comprises a waveguide transducer, wherein the waveguide transducer is a ridged waveguide, wherein a characteristic impedance of the waveguide transducer of the transmission mode transducer is equal to or less than a characteristic impedance of the microstrip line, wherein a characteristic impedance of the first λ/4 matching box is a higher impedance than a characteristic impedance of the transmission mode transducer and the characteristic impedance of the microstrip line, and is a lower impedance than a characteristic impedance of the waveguide, and wherein a second λ/4 matching box of a conductive conductor, having a lower impedance than the characteristic impedance of the waveguide and a higher impedance than the characteristic impedance of the first λ/4 matching box, is formed in the heat transfer plate.

9. The waveguide structure according to claim 8, wherein the first λ/4 matching box is a tapered impedance matching box provided on the multilayer substrate.

10. A waveguide structure comprising:

a microstrip line;

a waveguide; and a transmission mode transducer provided between the microstrip line and the waveguide, wherein the transmission mode transducer comprises a waveguide transducer, wherein the waveguide transducer is a ridged waveguide, and wherein a characteristic impedance of the waveguide transducer is equal to or less than a characteristic impedance of the microstrip line, the waveguide structure further comprising:

a multilayer substrate; and an RF circuit board, an RF circuit being provided on a top layer of the RF circuit board and the multilayer substrate; and a λ/4 matching box provided adjacent to an inner layer of the multilayer substrate, wherein the waveguide transducer and a waveguide of the λ/4 matching box are of a waveguide shape extending through to an undersurface of the multilayer substrate by alternately laminated dielectric and metal conductor films, each metal conductor film having a cut-out portion and being electrically connected to an adjacent metal conductor film through at least one via.

11. The waveguide structure according to claim 10, wherein a length of a shorter side of a rectangular cross-sectional opening of the ridged waveguide is twice or more than twice a thickness of a dielectric of the microstrip line, and wherein a ridge is provided near a center of one or both long sides of the ridged waveguide rectangular cross-sectional opening, projecting toward the center of the rectangular opening, wherein a distance from the ridge to the nearest part of the rectangular opening is twice or less than twice the thickness of the dielectric.

12. The waveguide structure according to claim 10, wherein the λ/4 matching box is connected between the waveguide and the waveguide transducer, wherein the waveguide structure constitutes input/output terminals for externally connecting the waveguide structure, wherein the microstrip line constitutes a millimeter waveband data line of the RF circuit, wherein a characteristic impedance of the λ/4 matching box is an intermediate value between the characteristic impedance of the microstrip line and a characteristic impedance of the waveguide.

13. The waveguide structure according to claim 12, wherein the transmission mode transducer connects the microstrip line to the waveguide transducer at a right angle.

14. The waveguide structure according to claim 10, further comprising an impedance matching box having a characteristic impedance ratio of three or less at input and output terminals thereof, the impedance matching box being formed on the multilayer substrate, wherein the impedance matching box is an impedance matching box formed on the multilayer substrate by a tapered artificial-waveguide having a length of λ/4 or less, with a taper angle satisfying the relation $\tan(\theta)/(\sqrt{(Er)})<0.3$, and having a reflection characteristic of −10 dB or less, where θ is the taper angle and Er is a dielectric constant of the multilayer substrate.

15. The waveguide structure according to claim 10, wherein the ridged waveguide is formed of ridges projecting near a center of one or both long sides of a rectangular cross-sectional opening of the ridged waveguide, and the ridged waveguide having a characteristic impedance less than that the characteristic impedance of the microstrip line, wherein a length of a ridged section comprised of the ridges is λ/4 or less from a face of the long sides of the rectangular cross-sectional opening of the ridged waveguide, and wherein the at least one via is disposed in a projection direction in the multilayer substrate.

16. A waveguide structure comprising:

a microstrip line;

a waveguide; and a transmission mode transducer provided between the microstrip line and the waveguide, wherein the transmission mode transducer comprises a waveguide transducer, wherein the waveguide transducer is a ridged waveguide, wherein a characteristic impedance of the waveguide transducer is equal to or less than a characteristic impedance of the microstrip line, wherein the waveguide structure further comprises a λ/4 matching box connected between the transmission mode transducer and the waveguide, and wherein a characteristic impedance of the λ/4 matching box is a higher impedance than the characteristic impedance of the transmission mode transducer and a characteristic impedance of the microstrip line, and is a lower impedance than a characteristic impedance of the waveguide.

17. The waveguide structure according to claim 16, wherein a length of a shorter side of a rectangular cross-sectional opening of the ridged waveguide is twice or more than twice a thickness of a dielectric of the microstrip line, and wherein a ridge is provided near a center of one or both long sides of the ridged waveguide rectangular cross-sectional opening, projecting toward the center of the rectangular opening, wherein a distance from the ridge to the nearest part of the rectangular opening is twice or less than twice the thickness of the dielectric.

18. The waveguide structure according to claim 16, wherein the ridged waveguide is formed of ridges projecting near a center of one or both long sides of a rectangular cross-sectional opening of the ridged waveguide, and the ridged waveguide having a characteristic impedance less than that the characteristic impedance of the microstrip line, wherein the ridged waveguide is formed in a multilayer substrate of alternately laminated dielectric and metal conductor films, wherein a length of a ridged section comprised of the ridges is λ/4 or less from a face of the long sides of the rectangular cross-sectional opening of the ridged waveguide, and wherein a plurality of electrically conducting vias are disposed in a projection direction in the multilayer substrate.

19. The waveguide structure according to claim 16, further comprising:

an RF circuit; and wherein the waveguide structure constitutes input/output terminals for externally connecting the waveguide structure, and wherein the microstrip line constitutes a millimeter waveband data line of the RF circuit.

20. The waveguide structure according to claim 19, further comprising:

a multilayer substrate;

an RF circuit board, wherein the RF circuit is provided on a top layer of the RF circuit board and the multilayer substrate, wherein the waveguide transducer and the λ/4 matching box are provided in an inner layer of the multilayer substrate, and wherein the transmission mode transducer connects the microstrip line to the waveguide transducer at a right angle.

* * * * *